US006097288A

United States Patent [19]

Koeppe, Jr.

[11] Patent Number: 6,097,288

[45] Date of Patent: Aug. 1, 2000

[54] EXPANDABLE, MODULAR ANNUNCIATION AND INTERCOM SYSTEM

[75] Inventor: Eugene Charles Koeppe, Jr., Lisle, Ill.

[73] Assignee: Lucent Technologies Inc., Murray Hill, N.J.

[21] Appl. No.: 09/257,400

[22] Filed: Feb. 25, 1999

[51] Int. Cl.[7] ..... G08B 23/00; G08B 25/08

[52] U.S. Cl. ..... 340/517; 340/521; 340/538; 340/539; 340/692; 340/286.11; 340/531; 369/53; 379/48; 379/51

[58] Field of Search ..... 340/517, 521, 340/692, 539, 310.01, 310.06, 286.11, 628, 531, 538, 632; 360/12; 369/53; 379/37, 48, 51, 167, 67.1, 159, 161

[56] References Cited

U.S. PATENT DOCUMENTS

| | | | |
|---|---|---|---|
| 3,925,763 | 12/1975 | Wadhwani et al. | 340/539 |
| 4,064,507 | 12/1977 | Schmitz | 340/692 |
| 4,581,606 | 4/1986 | Mallory | 340/539 |
| 4,951,029 | 8/1990 | Severson | 340/531 |
| 5,086,385 | 2/1992 | Launey et al. | 340/825.37 |
| 5,952,919 | 9/1999 | Merrill | 340/692 |

*Primary Examiner*—Donnie L. Crosland
*Attorney, Agent, or Firm*—Nancy R. Gamburd

[57] ABSTRACT

An expandable and modular intercom and annunciation system includes a plurality of signal sources, such as smoke detectors, breakage detectors, intrusion detectors, telecommunication detectors (such as ringers), and gas detectors. The system further includes a plurality of originating interface modules, each respectively coupled to a signal source for receiving signals from the corresponding plurality of signal sources and for converting the signals to common communication protocol signals. The system also includes a receiving interface module coupled to the plurality of originating interface modules for communication via the common communication protocol, and an intercom and annunciation unit coupled to the receiving interface module to receive the common communication protocol signals. The intercom unit has a processor, a memory, and a user interface including an audio output. The processor of the intercom unit is programmed with instructions to determine relative priorities among the plurality of common communication protocol signals, to select a first common communication protocol signal having a highest relative priority during a selected time interval; to announce a message corresponding to the first common communication protocol signal during the selected time interval, and to maintain a quiet interval for an announcement entered by an individual via the user interface, such as for a broadcast of instructions for responding to an alarm condition.

35 Claims, 8 Drawing Sheets

EXPANDABLE, MODULAR ANNUNCIATION AND INTERCOM SYSTEM

FIELD OF THE INVENTION

The present invention relates in general to coupled modular devices that provide audible outputs. More specifically, the invention relates to expandable systems of coupled modular intercoms wherein additional signal sources may be incorporated using a standardized communications interface.

BACKGROUND OF THE INVENTION

Both residential and commercial buildings contain various user friendly sources of audio signals as well as other, different types of sources for originating electrical and audible signals indicative of various conditions. The user friendly audible signal generating units, for example, include wired and wireless intercoms. Such units make delivery of audible messages throughout various regions of a home or a commercial establishment convenient and immediate. Such units can be implemented as substantially stand-alone intercom-type systems or can be integrated into other types of communications devices, such as one or more telephones distributed throughout a residence or a commercial establishment.

Other signal originating sources are quite unlike the audible signaling units, both electrically and mechanically. Typical examples of signal originating units include various annunciators, such as doorbells, conventionally associated with the exterior doors of residences and some commercial establishments.

Other signal originating sources include security systems, such as fire or burglar alarm systems, which at times generate electrical signals indicative of one type of alarm condition or another. In such systems, the electrical signals are often converted to audible alarm indicators. Other types of signal originating sources may also include heating or lighting systems, radios, televisions, audio reproduction systems, telephone ringing devices and the like.

While there may be one or more annunciating devices associated with each such signal originating sources, at times it is desirable to add additional output devices both locally and remotely from the source. Even adding identical types of annunciator devices to a given originating source can be difficult and produce unsatisfactory results. For example, adding another annunciator to a given signal originating source will subject at least the output portion of that source to an additional electrical load. At times, there are fixed limits as to the number of annunciators that may be used in connection with a particular source due to available power or regulatory requirements.

Where the source does, however, have the electrical capability to drive one or more annunciators, running wires or other electrical connectors between the source and the annunciator may be difficult, even on a local basis. In some instances, it may be effectively impossible to run wires for a more remote installation of an annunciator. Additionally, annunciators associated with different types of systems are often not interchangeable and have very different electrical characteristics.

Various systems may also combine multi-detector monitoring devices with a common control unit and one or more operator communications panels, which include a keypad, a display and an audible output transducer. Communications between the detectors and the control unit may occur in wired or wireless media.

Audible indicators of detected conditions, such as audible or visual alarms, can be provided via such operator communications panels. Multiple different detectors can be coupled to separate interfaces, or to a common interface, that in turn provides communication with the control unit.

While effective, known monitoring systems are designed to provide indications of predetermined conditions. Such known monitoring systems typically accept as signal sources a limited number of different types of detectors, and are not intended to support a bidirectional transfer of verbal information.

As a consequence, a need remains for systems or other devices that would facilitate coupling disparate types of annunciators to a variety of different originating sources, both locally and remotely. Preferably, different types of signal sources could be readily mixed and in some fashion coupled to types of annunciators that otherwise might not be used with the respective sources. In addition, such systems preferably should also enable users to communicate audibly with one another. Preferably, such systems would be user friendly, readily installable, and usable with both a variety of signal sources and annunciators.

SUMMARY OF THE INVENTION

An audible communication and monitoring system incorporates a plurality of user friendly annunciator or intercom units. Each of the intercom units includes a user interface, such as a keypad for entry of information, a visual display, and audio input and output. Each of the units includes wired or wireless communication circuitry having a transmit mode and a receive mode.

An interface for transmitting or receiving information, in a predetermined communications protocol via a selected medium, is connected to the communication circuitry. A plurality of source modules, each of which incorporates compatible interface circuitry, is in communication with one or more annunciator units. Each source module is coupled to or incorporates interface circuitry for converting signals received from a plurality of originating sources to a format compatible with the communication protocol. Various originating sources may include, for example, smoke and heat detectors, carbon monoxide detectors, intrusion detectors (such as window and door sensors), and telecommunication detectors (such as telephone ringers).

In the preferred system embodiment, a common, multi-signal receiving and transmitting interface is incorporated into each of the annunciator or intercom units. A plurality of interface modules are coupled, respectively, to the various signal originating sources. In an alternate embodiment, a plurality of interfaces could be coupled to limited capacity annunciators.

In yet another aspect, interface modules can be provided which are specific to an originating source. For example, a doorbell receiving module could be coupled to a selected annunciator or intercom unit. In responding to a doorbell indicating signal, the respective annunciator/intercom unit could generate a local audible message or tone. It could also transmit a signal to other, more remotely located annunciators/intercom units in the system. This in turn would cause the respective annunciator to produce an appropriate audible message within its local vicinity or range.

Alternately, a telecommunication interface, an intrusion detector interface, or the like can be provided for use with one or more annunciators or intercom units. Compatible interface modules can be coupled to the respective signal sources.

Source interfaces can incorporate at least one programmable processor, input circuitry and circuitry for transmitting, wirelessly or otherwise, signals conforming to a predetermined communications protocol to one or more receiving interfaces.

Source interfaces can be adapted to receive signals from a single type of signal originator. Alternately, a source interface can include input circuitry couplable to a plurality of different signal originators.

The receiving interfaces can be an integral part of each respective annunciator or intercom unit. Alternately, the interfaces can be removably coupled to respective annunciators.

The receiving interfaces can be source specific. These are intended to receive signals from a particular type of originating source. Alternately, they can receive signals from a plurality of originating sources.

Received signals can be prioritized and processed at a receiving annunciator, or the respective interface. Higher priority signals, received from an alarm originator, such as a fire or intrusion detector, can result in relatively immediate, audible, alarm outputs from the receiving annunciator as well as the other annunciators of the system.

Subsequent to an audible alarm indicator having been emitted, the indicator can be temporarily interrupted and silenced. This silent interval enables an individual in the vicinity of one of the annunciators to transmit a verbal message to other annunciators coupled thereto for informational or instructional purposes.

Contention for the communications link can be addressed by various techniques. An interface wishing to transmit can monitor the link. If the link is available, it can issue an alert or link seizure signal indicating to other interfaces that the link is now unavailable to them, and a message bearing transmission can then be initiated. A receiving interface, for example coupled to an annunciator, can analyze a received message and then load received message into a list or queue for processing.

Polling schemes can be used to minimize collisions or contention for the link. Alternately, a transmitting interface can listen for an acknowledge signal. If an acknowledge signal is not received, another transmission can be initiated.

In one aspect, arbitration or message collision avoidance circuitry can be provided at one or more of the annunciator units for prioritizing and determining the order in which a plurality of signals will be received and announced. As a result, a single annunciator unit will be able to respond appropriately to a plurality of signals received from disparate originating sources. Hence, it will be unnecessary to add additional annunciators in a given area.

In one embodiment, the modules can be interconnected via a common, wired signaling bus. The bus can take the form of building utility, AC, wiring. Alternately, wireless communication can be used.

In another aspect, the arbitration circuitry can be implemented to assign a highest level of priority to received voice communications. In yet another aspect, the annunciator units and/or the modules can each incorporate a programmed processor for the purpose of carrying out required control functions.

An interface module can incorporate a plurality of inputs to which respective originating sources can be coupled. Where the utility lines are used for communication, it is only necessary to plug the annunciator units and the modules into the AC line outlets to initiate communication. Arbitration or collision avoidance circuitry can be incorporated into one or more of the signal originating modules.

Numerous other advantages and features of the present invention will become readily apparent from the following detailed description of the invention and the embodiments thereof, from the claims and from the accompanying drawings.

DETAILED DESCRIPTION OF THE INVENTION

Figure 1:
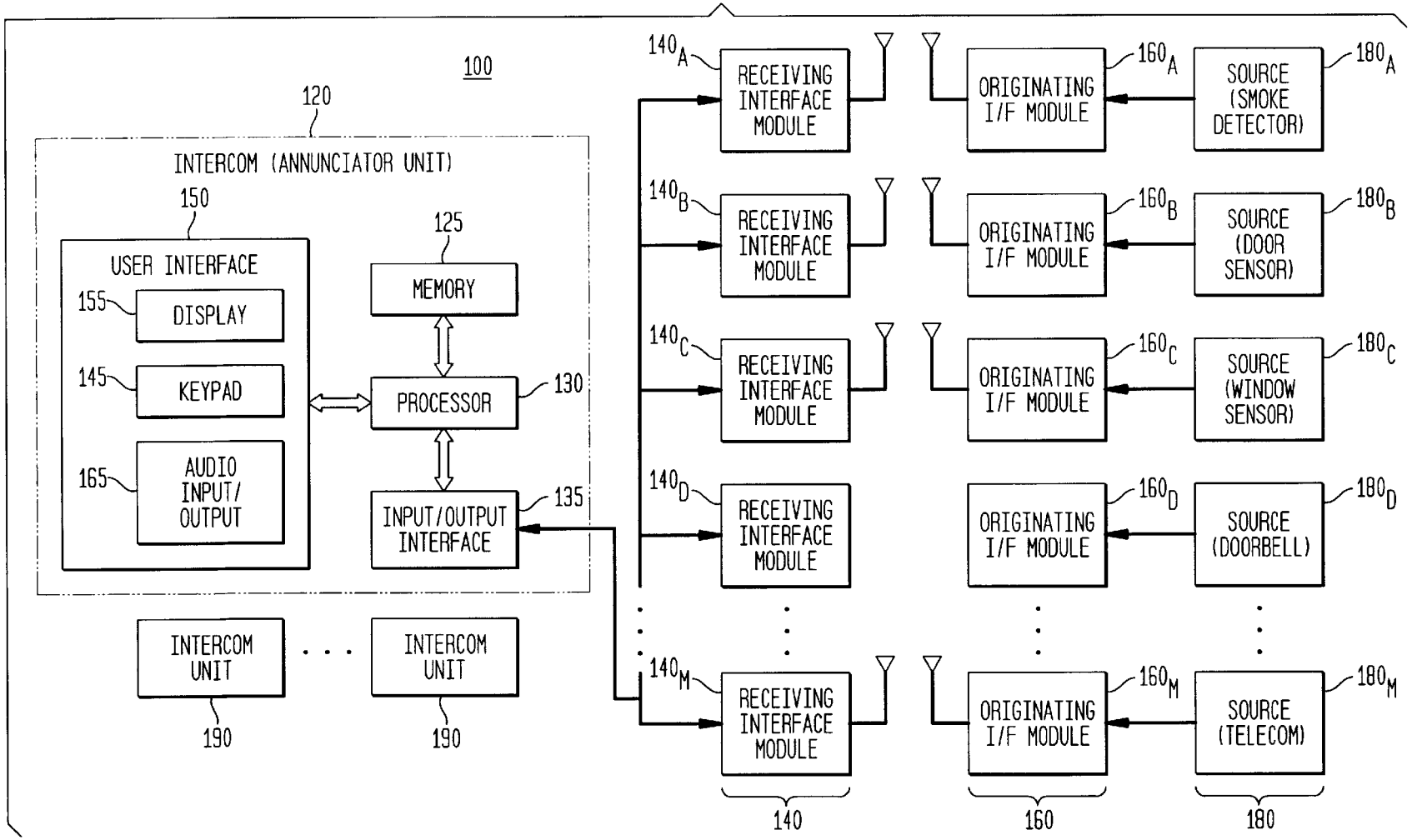
FIG. 1 is a block diagram illustrating a first system embodiment in accordance with the present invention.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

In accordance with the present invention, an annunciation and intercom system is provided which facilitates coupling of disparate types of originating sources, both locally and remotely, to a central or common intercom and annunciation system. Different types of signal sources may be readily mixed and coupled to a common intercom and annunciation system, that otherwise might not be used with these respective sources. In addition, the preferred system is user friendly, readily installable, enables users to communicate audibly with one another, and usable with both a variety of signal sources and annunciators.

FIG. 1 is a block diagram illustrating a first, preferred system embodiment 100 in accordance with the present invention. The system 100 includes an intercom or annunciator unit 120 which is coupled via an input/output (I/O) interface 135 to a plurality of receiving interface modules 140. It will be understood that a singular or common bidirectional interface (not illustrated) could be used instead of the plurality of separate receiving interfaces 140 without departing from the spirit and scope of the present invention.

The receiving interface modules 140 are each in communication, wirelessly (as illustrated) or wired, or a combination of both, with a set of originating or source interface modules 160. Each of the plurality of originating interface modules 160 are associated with a corresponding particular signal source 180 of a plurality of signal sources 180. As illustrated in FIG. 1, for example, originating interface module $160_A$ is connected to a smoke detector $180_A$, and originating interface module $160_B$ is connected to a door sensor $180_B$. Other signal sources 180, as illustrated, include a window sensor $180_C$, a doorbell $180_D$, and a telecommunication source $180_M$ (such as a telephone or a telephone line jack), each coupled to respective originating or source interface modules $160_C$ through $160_M$. The members of the plurality of originating interface modules 160 are each used to interface a particular source or origination element of a signal to the central or main intercom or annunciator unit 120. More specifically, the originating interface modules 160 receive signals from their respective disparate signal sources 180, and interface or translate those received signals into a common communication protocol for reception and processing by one or more an annunciator/intercom units 120 or 190.

Where communication between the members of the pluralities of interfaces 140 and 160 is wireless, as illustrated, the system 100 is very easy to install, as no additional wiring is needed. Alternately, also for ease of installation, instead of wireless signaling, utility line (AC power line) signaling can be implemented using pre-existing, installed AC lines.

Communication can also be carried out via installed wiring, such as special cable or wiring installed for that purpose or for other purposes. For example, the members of the plurality of receiving interface modules 140 could also be coupled to corresponding originating interfaces 160 using previously installed telephone wiring in the region.

While each of the members of the plurality of originating interface modules 160 has been illustrated associated with a particular single signal source 180, it will be understood that members of the plurality of originating interface modules 160 could be adapted to receive a plurality of different signal inputs if desired. The members of a plurality of originating interface modules 160 can be source specific or they can be programmable to be adaptable to a given type of signal source 180.

It will be understood that the members of the pluralities of interfaces 140 and 160 can be implemented in a variety of different forms without departing from the spirit and scope of the present invention. Similarly, in the event of a wireless communication, the members of the pluralities of interfaces 140 and 160 might include transmitters, receivers or transceivers of various configurations without departing from the spirit and scope of the present invention.

A plurality of wired or wireless intercom-type units 190 is coupled to the central or main intercom or annunciator 120. It will be understood that the members of the plurality of intercom units 190 could be substantially identical to the structure and operation of the intercom or annunciator 120. Alternately, some or all of the members of the plurality of intercom units 190 could exhibit more limited functionality without departing from the spirit and scope of the present invention. Interfaces corresponding to the members of the plurality of receiving interface modules 140 can be removably coupled to or formed integrally with the intercom unit 120 or with the members of the plurality of intercom units 190.

The intercom or annunciator unit 120 includes a programmable processor 130 which is in turn coupled to a user interface 150. The user interface 150 includes some form of operator input device, such as a keypad 145; a visual output device, such as a display 155; and an audio input and output device 165, such as a microphone and a speaker.

The processor 130 is also coupled to memory 125 for storing executable programs, temporary storage of information, and pre-recorded or pre-stored messages. It will be understood that the messages could be pre-established messages indicative of the existence of signals from one or more of the sources. For example, stored messages could include statements that an alarm condition such as smoke or fire had been detected. Other messages could indicate detection of a door opening, or window being broken and the like. Yet, other messages could indicate that the doorbell is being rung or that an incoming telephone call had been detected. In addition to pre-stored tones or messages, memory 125 could also store one or more digitized messages input via audio input/output device 165 by a user. For such a case, the processor 130 preferably includes digital signal processing capability, as discussed in greater detail below.

Input and output interface circuitry 135 couples the intercom unit 120 to the members of the plurality of receiving interface modules 140. Members of the plurality of receiving interface modules 140 can be associated with a particular form of a source interface module 160 and corresponding source, such as for a source smoke detector $180_A$ or a source door sensor $180_B$. Alternately, the members of the plurality of receiving interface modules 140 could be programmed to respond to a variety of incoming signals from different sources 180.

Continuing to refer to FIG. 1, the processor 130 (and the various other processors illustrated below with reference to FIG. 7) may include a single integrated circuit ("IC"), or may include a plurality of integrated circuits or other components connected, arranged or grouped together, such as microprocessors, digital signal processors ("DSPs"), application specific integrated circuits ("ASICs"), associated memory (such as RAM and ROM), and other ICs and components. As a consequence, as used herein, the term processor should be understood to equivalently mean and include a single processor, or arrangement of processors, microprocessors, controllers, or some other grouping of integrated circuits which perform the functions discussed in greater detail below, with associated memory, such as microprocessor memory or additional RAM, ROM, EPROM or $E^2$PROM. The methodology of the present invention, as discussed in greater detail below with reference to FIGS. 2–6, may be programmed and stored, in the processor 130, with associated memory and other equivalent components, as a set of program instructions for subsequent execution when the processor 130 is operative (i.e., powered on and functioning). For example, the processor 130 generally includes instructions for operation of the user interface 150 and for responding to the various functionalities which may be introduced by any one of the plurality of sources 180 (with corresponding interfaces 140 and 160).

It will be understood that the illustrated architecture of the system 100 of FIG. 1 is exemplary. Other architectures may be used without departing from the spirit and scope of the present invention.

In the event that some of the members of the plurality of intercom units 190 corresponded structurally to the unit 120, those members could also be coupled to one or more interface modules corresponding to the plurality of modules 140. These in turn could be coupled to additional originating source interface modules 160 that do not necessarily communicate directly with intercom unit or annunciator 120. Hence, for example, an intercom unit 190 could be coupled to a doorbell source interface module, such as module $160_D$. In response to receipt of a doorbell ringing signal at the module $160_D$, that information can be transmitted from the intercom unit 190 to unit 120, which can in turn generate either a tone or an audible, human perceptible message via the audio input/output 165.

In the preferred system embodiment 100, the intercom unit 120 also can communicate with one or more of the members of a plurality of intercoms 190, transferring a signal thereto for the purpose of producing either tones or audible messages at locations remote from either the intercom unit 120 or, for example, the doorbell $\mathbf{180}_D$. An indication of an alarm condition, such as a signal from the window breakage sensor $\mathbf{180}_C$ could be coupled to intercom unit 120 for purposes of generating an audible alarm message locally to the unit 120. In addition, intercom unit 120 could transmit one or more signals to one or more members of a plurality of intercom units 190 for the purpose of generating additional audible messages or tones indicating, remotely, the existence of the sensed broken window at sensor $\mathbf{180}_C$. As a consequence, a bidirectional communications link, preferably for audio transmission, exists between and among the various annunciator or intercom units 120 and 190. The communications link, as mentioned above, may be wireless or wireline.

Sources 180, which may be coupled only to members of the plurality of intercoms 190, may also originate signals or events which, in turn, also result in audible signals or messages being broadcast to and then from other annunciators, such as intercom unit 120 and other members of the plurality of intercoms 190.

As mentioned above and as discussed in more detail below, circuitry and program instructions in unit 120 and intercoms 190 also enable a local user to, on a high priority basis, transmit an audible or voice message to some or all of the members of the plurality of intercoms 190, either during or after an alarm message has been generated. This enables a user in the vicinity of an intercom 120 or 190 to respond to an event and send a spontaneous message to other intercoms 120 or 190. This message can provide additional information or instructions to other individuals in the vicinity of the main or central intercom or annunciator 120 and also the members of the plurality of intercoms 190.

As discussed subsequently, the intercom unit 120 can include an arbitration module to address collisions or contention problems on the common communication link, discussed in greater detail below with reference to FIGS. 2 and 6. In this regard, unit 120 as well as members of the plurality of intercom units 190 can each include hardware and software to address such collisions or contention problems. In the preferred embodiment, such arbitration or contention capability is incorporated, as a set of executable program instructions, within the processor 130.

Figure 2:
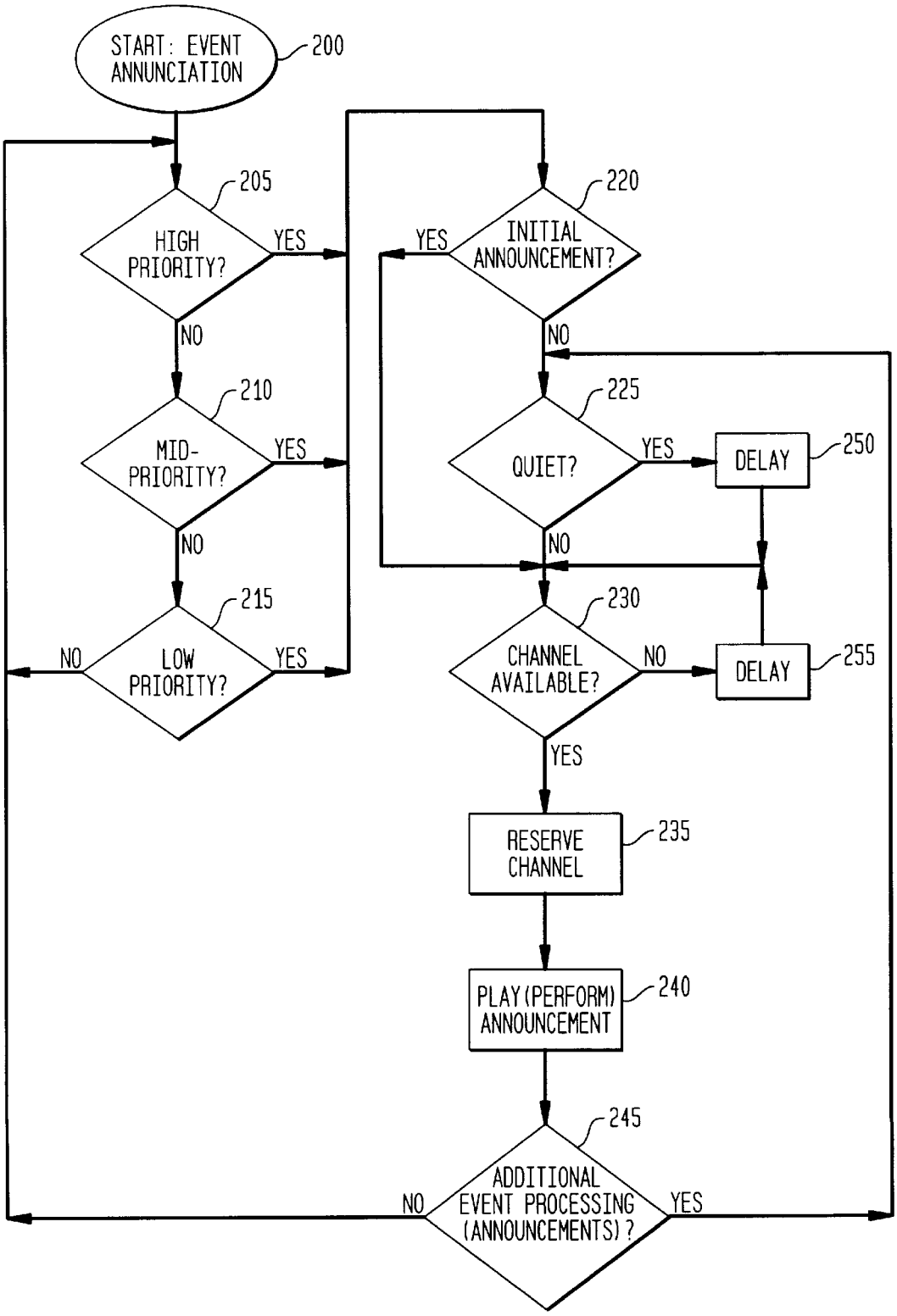
FIG. 2 is a general flow diagram of annunciation processing in accordance with the method of the present invention.

FIG. 2 is a general flow diagram of annunciation processing in accordance with the method of the present invention. As mentioned above, the method illustrated in FIG. 2 may be embodied within the system 100 of FIG. 1, and more particularly, programmed and stored as instructions within the processor 130 of intercom unit 120, or similar intercoms of the plurality of intercom units 190.

The annunciation processing of the present invention concerns playing announcements or sounding alarms, of various types, depending upon the occurrence of various events, through a centralized system, such as system 100. Events may include, for example, a smoke alarm condition from source $\mathbf{180}_A$, a ringing telephone from source $\mathbf{180}_M$, a ringing doorbell from source $\mathbf{180}_D$, and so on. Other events may be pre-programmed for announcement by the system 100, such as a reminder message to make a telephone call or watch a television program.

As a consequence, in accordance with the present invention, events can be pre-programmed, manually created for current announcement (and stored, for example, in memory 125), or can be created by an originating source 180. All events are assigned a relative or comparative priority; for example, potential fire conditions are assigned a higher priority than a reminder message. When generated, events are loaded into a list or queue, with each event having an appropriate relative priority. Alternatively, a plurality of queues may be established, each corresponding to a given relative priority level, into which a given event may be loaded which has that corresponding priority level. At various intervals, the queue(s) are respectively scanned and, as appropriate, based on a given event's parameters, the event is announced through the system 100.

Referring to FIG. 1, beginning with start step 200, the method first examines the high priority queue or list into which high priority events are loaded when received (or, equivalently, examines a single, overall queue for any high priority events), step 205. For example, high priority events would include outputs from alarm signal originating sources, such as source $\mathbf{180}_A$ (smoke alarm), source $\mathbf{180}_B$ (door alarm), and source $\mathbf{180}_C$ (window alarm). As discussed in greater detail below, when there are high priority events in step 205, the method proceeds to step 220, and in accordance with the present invention, these events are announced as appropriate.

Following processing and announcing of all high priority events, the queue is examined for intermediate or medium priority events, step 210, which are then processed and announced, also proceeding to step 220. Medium priority events, such as outputs from doorbell source $\mathbf{180}_D$, can be loaded into a medium priority queue or list.

Finally, in step 215, the lowest priority events are examined and announced as appropriate, also proceeding to step 220. The lowest priority events, such as pre-programmed events and other reminder announcements, are preferably loaded into the lowest priority queue or list or portion thereof.

In operation, the processor 130, in a step 205, examines the highest priority queue or list and, if there are any high priority events, the processor 130 extracts an event therefrom. The nature of the extracted event is analyzed and a determination is made, in step 220, as to whether the event requires an initial announcement. If so, in step 230, the availability of the communication link or channel within, between and among the various intercom units 120 and 190, wired or wireless, is ascertained.

If the communication link or channel is available in step 230, it is seized or reserved by transmitting a seizure or reservation signal, step 235. In the preferred embodiment, the reservation signal may correspond to a signal of a predetermined frequency for a predetermined period of time, such as a short reservation burst.

Following reservation of the communication link in step 235, in step 240, the event will be announced, for example, at the audio output 165 of the intercom unit 120. In the preferred embodiment, the event is also transmitted to corresponding audio outputs of the members of the plurality of intercom units 190. Those members of the plurality of intercom units 190 which receive the event, or which receive an audible message or a representation thereof from the originating intercom unit 120, can also announce the event, thereby making its existence known at various displaced or remote locations without a need, where wireless communication is being used, to install any wires. In addition, such remote communication may occur for sources 180 which otherwise may not be heard; for example, a door bell or telephone announcement may occur in a basement workshop, which otherwise would have been missed due to its remote location from the traditional annunciators.

Following the announcement of the event, in step 245, a determination is made as to whether processing of the event is complete. When processing of the event is complete in step 245, the processor 130 returns to the step 205, to determine whether other events (high, medium or low priority) may need processing. If the processing of the event is not complete in step 245, the processor 130 determines if the event being processed has a quiet interval associated therewith between successive announcements, step 225. If so, and if the quiet time has not elapsed or terminated for that event, the quiet interval is permitted to elapse and time out in a delay step 250. Such a quiet time may be utilized, for example, between successive fire alarm announcements, to allow for verbal communication among family members or office personnel via the communications link of the system 100.

At the end of the quiet time interval in step 250, the availability of the communications link or channel is again determined in step 230. If available, the channel is reserved again, step 235. The event announcement is issued again in step 240. In the event that the channel is unavailable (or busy) in step 230, the processor 130 could, for example, continue to monitor the channel until it becomes available (returning to or staying within step 230), or issue an overriding supervisory signal to clear the channel in the event of a high priority event, or delay for a period of time (step 255) before once again determining channel availability in step 230.

As mentioned above, when the processing of the event has been completed in step 245, the method (via processor 130) returns to step 205 for processing of other events which may exist. If the high priority event queue has been emptied in step 205, the processor 130 will determine whether intermediate priority events need processing step 210, for example, examining a medium priority queue. If a medium priority event is in the queue in step 210, the event will be processed and announced as described above, returning to step 220. In the event that the medium priority queue is empty or has been cleared in step 210, the lowest priority queue or list will be examined in step 215. Any events having a low priority or which are otherwise within the lowest priority queue will be processed and announced, also returning to step 220. As illustrated in FIG. 2, in the preferred embodiment, event processing runs continually, looping or returning to step 205 to determine whether any other or new events require processing.

As mentioned above, processing of events in accordance with the present invention provides a quiet time, steps 225 and 250, wherein an individual located near any of the plurality of intercom units 120 or 190 may inject a verbal, audible, message into the annunciation sequence. This message is in turn broadcast to other annunciators or intercom units 120 and 190, and provides the capability for additional information to be broadcast to individuals in the vicinity of those other intercom and annunciation units 120 and 190, for example, providing information perhaps as to actions to be taken or the reason for the event being announced.

The events that are processed according to the method of the present invention, as illustrated with respect to FIG. 2, can include manual requests entered via the user interface 150, such as via keyboard or keypad 145. Such manually entered requests or events may include events for immediate execution, pre-programmed events to be announced or executed at some point in the future, and events from other sources such as signal originators.

Pre-programmed events can include calendar events with reminders of dates and times of various activities. For example, the dates and times of television programs to be recorded using a VCR coupled to unit 120 can be pre-programmed. Dates and times linked to events which merely need to be announced for reminder purposes, such as a dental appointment, can also be pre-programmed.

Figure 3:
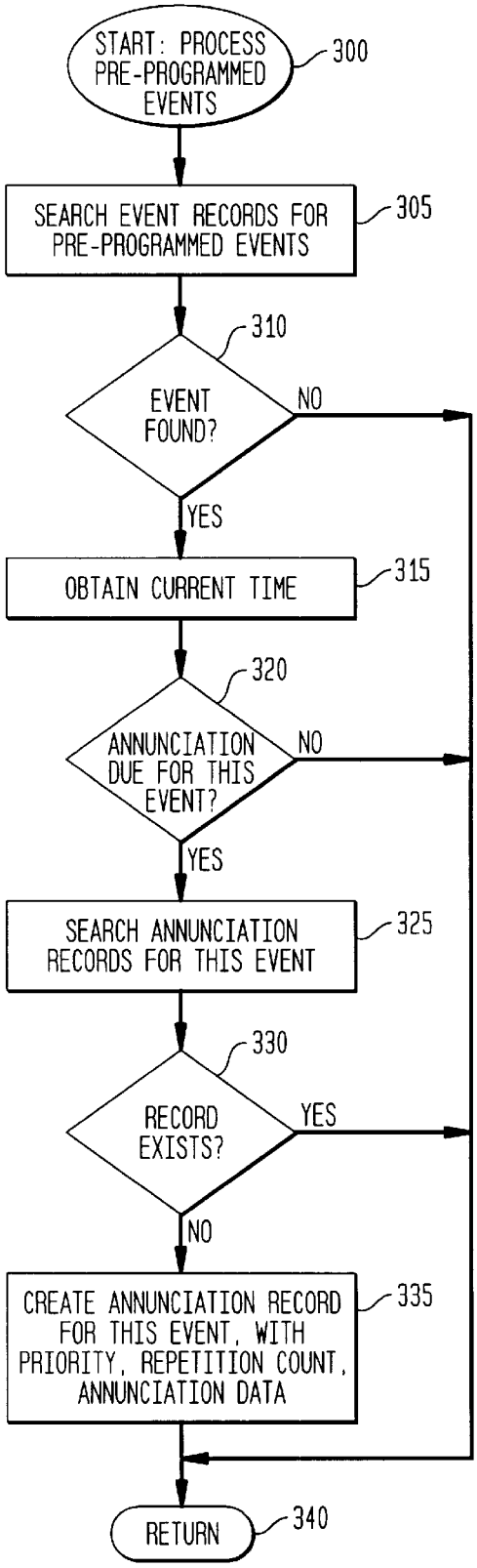
FIG. 3 is an exemplary flow diagram illustrating processing of pre-programmed events in accordance with the method of the present invention.

FIG. 3 is an exemplary flow diagram illustrating processing of pre-programmed events in accordance with the method of the present invention. Beginning with start step 300, a log or event record of pre-programmed events is searched, preferably by processor 130, step 305. If an event is found during the search, step 310, the current time is obtained, step 315. If, based on the retrieved entry from the log and the current time and date, annunciation is due for the respective event, step 320, the annunciation records are searched for the respective event, step 325. If the record exists and is found (step 330), no further processing is necessary, and the processing of pre-programmed events may end, return step 340. If in step 330, the record has not been found in step 330, it will be created in step 335, and loaded into an appropriate queue for annunciation with the corresponding appropriate priority, at the appropriate date and time, with a desired repetition count. Following step 335, processing of pre-programmed events may end, return step 340.

Figure 4:
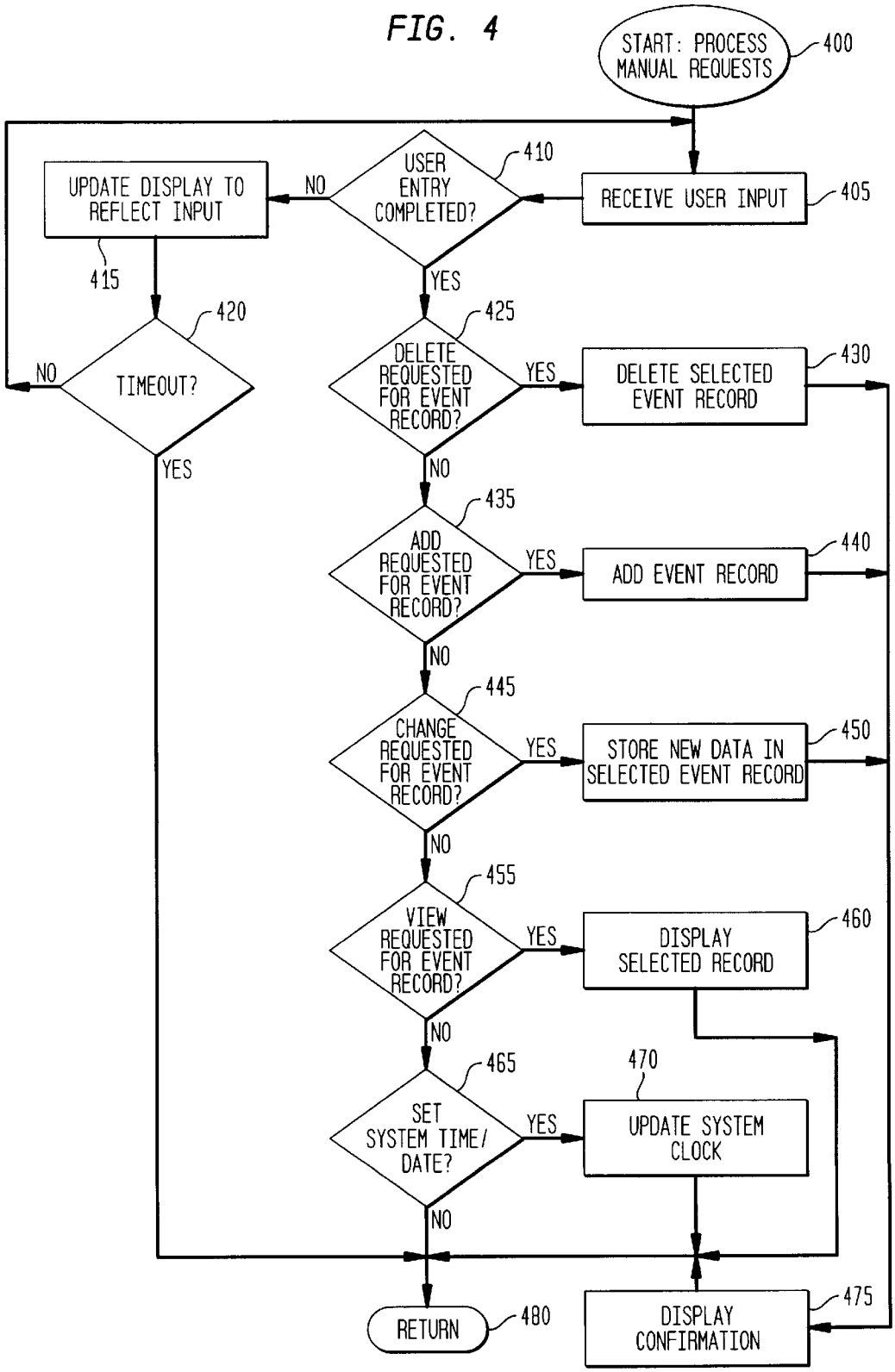
FIG. 4 is an exemplary flow diagram illustrating processing of manually entered events in accordance with the method of the present invention.

FIG. 4 is an exemplary flow diagram illustrating processing of manually entered events in accordance with the method of the present invention. In the preferred embodiment, such manual entry is utilized, for example, to enter pre-programmed events (FIG. 3), add or delete event records, and to change or view event records. Beginning with start step 400, user input is received, step 405, such as through the keypad 145 of the user interface 150. Such user input may be in the form of, for example, an entry code or a menu selection. If the user entry is not completed in step 410, the user display is updated to reflect the input, step 415. If the entry of user input has not timed-out in step 420, the method returns to step 405 to continue to receive user input. If the entry of user input has timed-out in step 420 because, for example, the user has been interrupted by another activity, no record changes are made and the processing may end, return step 480.

When the user input has been completed in step 410, for example, a completed command sequence has been entered, the command is subsequently analyzed. When a deletion of an event record has been requested, step 425, that command is recognized and the selected event is deleted in a step 430. When an addition of an event has been requested, step 435, that command is recognized and the event will then be entered and recorded, step 440. When a change of an event has been requested, step 445, that command is recognized and the changed data will be entered and stored in the record, step 450. Following a deletion (step 430), an addition (step 440) or a change (step 450), a confirmation is displayed, step 475.

When a command has been entered to retrieve a record for review, that command is recognized, step 455, and the record will be displayed, step 460. In the event that a system clock setting command has been entered, that command will be recognized, step 465, the system clock will then be updated, step 470. Following steps 460, 470 and 475, the processing of manually entered events is complete, return step 480.

Figure 5:
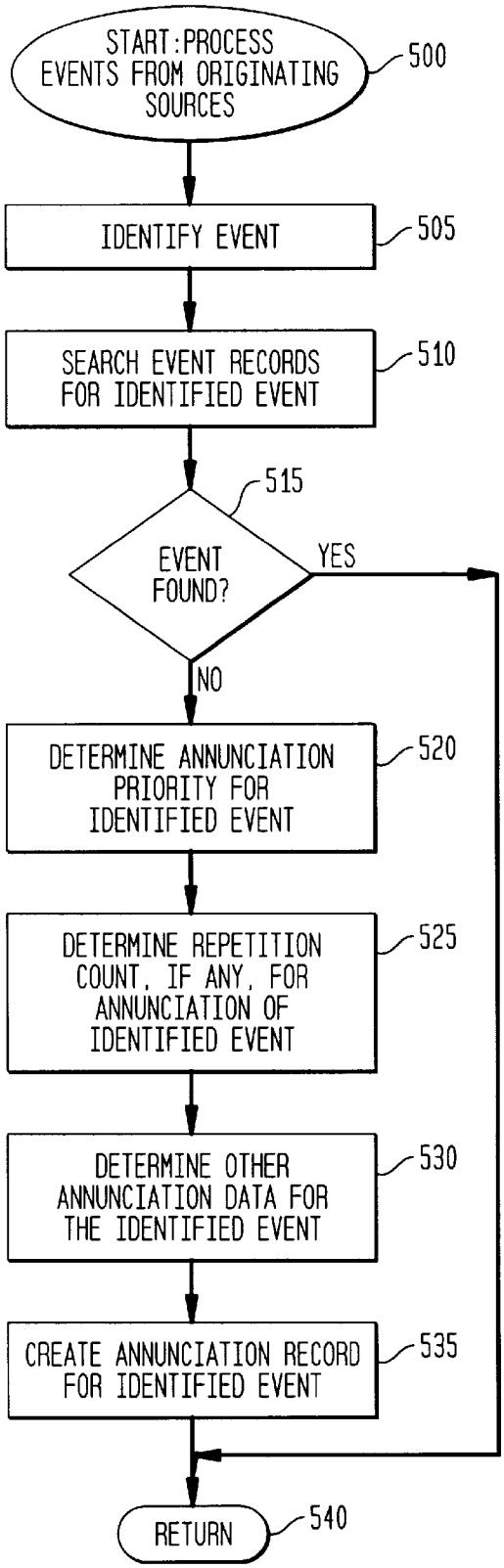
FIG. 5 is an exemplary flow diagram illustrating processing incoming events from originating sources in accordance with the method of the present invention.

FIG. 5 is an exemplary flow diagram illustrating processing incoming events, based on signals received from originating sources 180, in accordance with the method of the present invention. Beginning with start step 500, based upon the signal received from a member of the plurality of originating sources 180, an incoming event is identified, step 505, such as a smoke alarm or a ringing door bell. Existing event records are searched, step 510, to determine whether the event has already been placed into a queue for annunciation (FIG. 2). If a record has been found for the identified event, step 515, then no further processing is necessary, return step 540. When a record for the event has not been found in step 515, then such a record will be created and placed into a queue for subsequent annunciation.

First, in step 520, an appropriate relative priority is determined and assigned to the identified event. For example, a fire alarm will generally have a higher priority for annunciation than a ringing door bell. Next, in step 525, an appropriate repetition count is determined and assigned to the event. For example, if the event is an intrusion alarm, that event may be announced several times for the benefit of individuals in the vicinity of the various annunciation and intercom units 120 and 190. In step 530, other annunciation data specific or pertinent to the identified event are determined, such as specification of one or more prerecorded announcements to be audibly produced, or determination of text and tone parameters for synthesis purposes. Lastly, in step 535, an annunciation record is created, having a specified priority, a repetition count and other data, and is entered into the appropriate queue. Following step 535, processing of events from originating sources may end, return step 540.

Figure 6A:
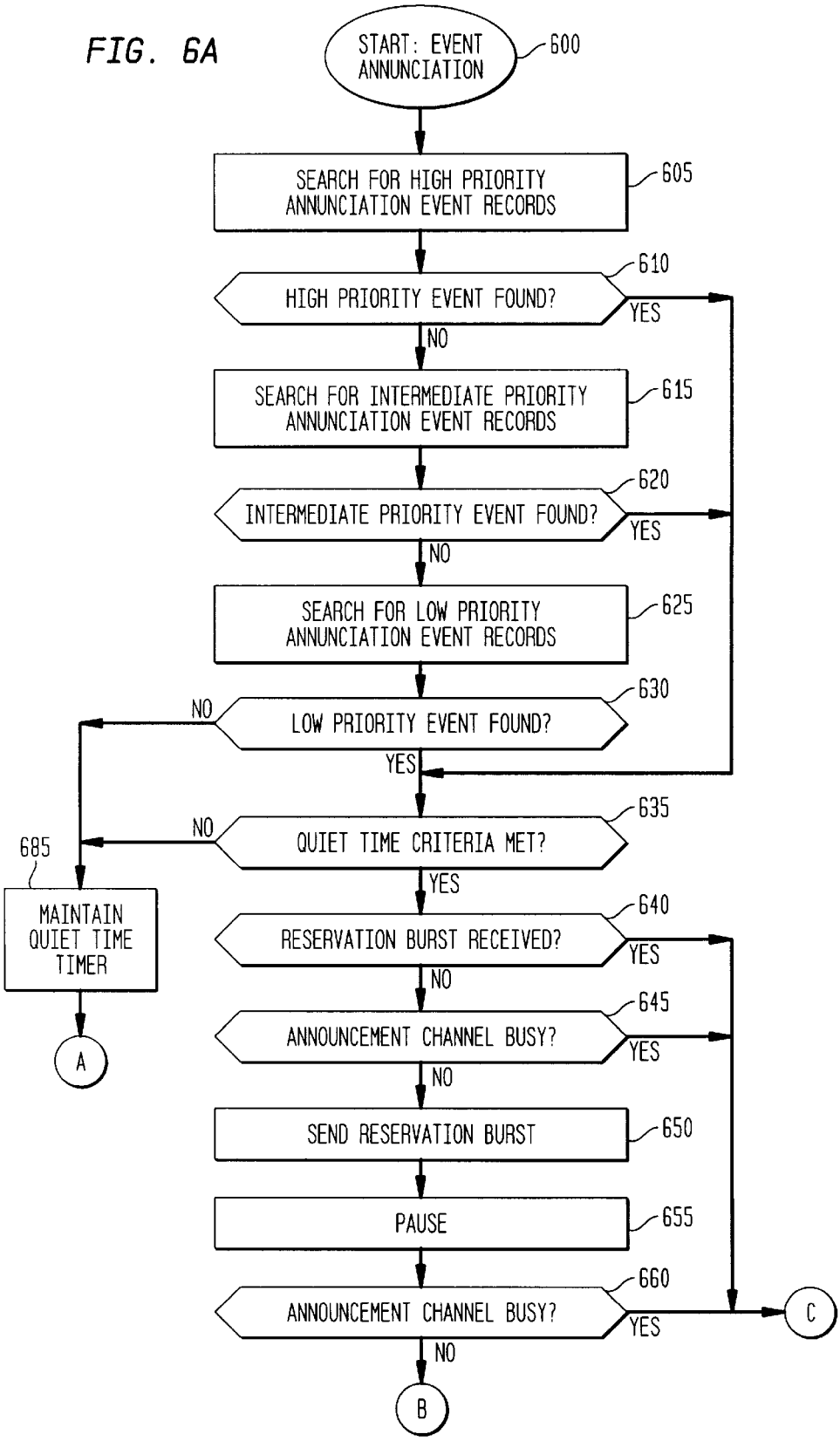
FIG. 6 is a detailed flow diagram illustrating annunciating processing in accordance with the method of the present invention.
Figure 6B:
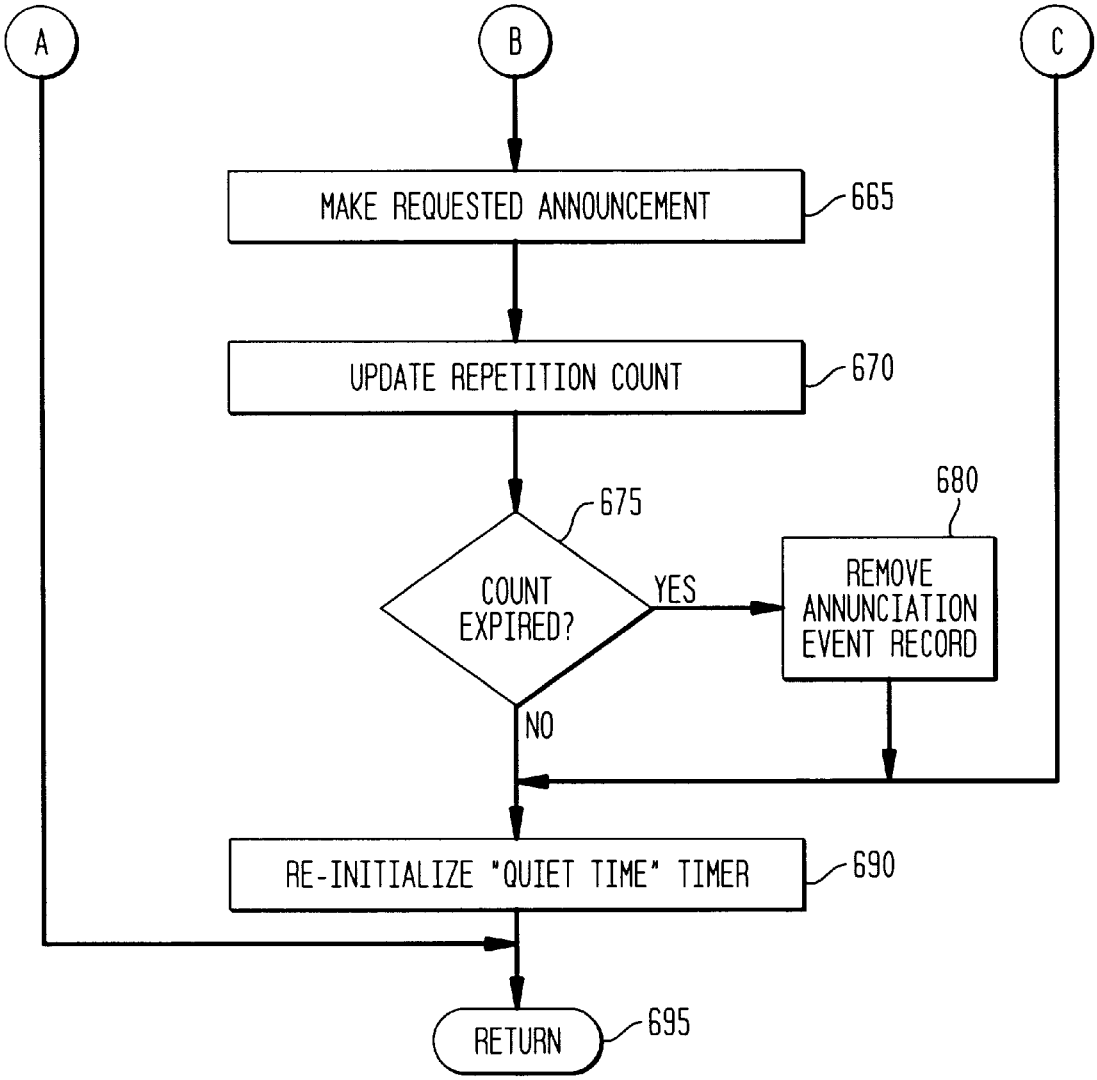

FIG. 6 is a detailed flow diagram illustrating annunciating processing in accordance with the preferred method of the present invention. Beginning with start step 600, the processor 130 searches the queue (or queues) for highest priority events, step 605. If no high priority event is found, step 610, then the processor 130 searches the queue (or queues) for intermediate or medium priority events, step 615. If no event intermediate priority event is found, step 620, then the processor 130 searches the queue (or queues) for low priority events, step 625. If no events, of any priority, have been found in the various steps 610, 620 and 630, the system continues to maintain the quiet time timer, step 685, and the event announcement processing may end, return step 695.

When an event of corresponding priority was found in any of steps 610, 620 or 630, the quiet time criteria are evaluated, step 635, such as whether there is a quiet time interval in progress to allow other usage of the communication link of the system 100. In the event that the quiet time criteria have been met and an announcement is appropriate (step 635), then a determination is made as to whether or not a channel preempting "reservation burst" signal has been received, step 640, namely, whether another, higher priority event has reserved or preempted use of the communication link. If a higher priority event has not reserved of preempted use of the communication link, step 640, and if the announcement channel is not currently in use or otherwise busy, step 645, then the intercom unit 120 will issue its own channel seizing "reservation burst" signal, step 650.

After a pause following the reservation burst, step 655, to avoid potential contention issues, the processor 130 again determines if the announcement channel is available, step 660. When the channel is available, the announcement associated with the respective event is made, step 665. Following the announcement of the event, a repetition count for the event is updated, step 670. If the repetition count for the event has expired, step 675, such that all repetitions of the announcement have been made, the respective event record is removed from the queue, step 680. Following the various steps 640, 660, 675 and 680, the quiet time timer is re-initialized, step 690, and the event annunciation process may end, return step 695.

Those of skill in the art will recognize that various alternative processing schemes can be implemented without departing from the spirit and scope of the present invention. For example, various message collision avoidance schemes come within the scope hereof.

Figure 7:
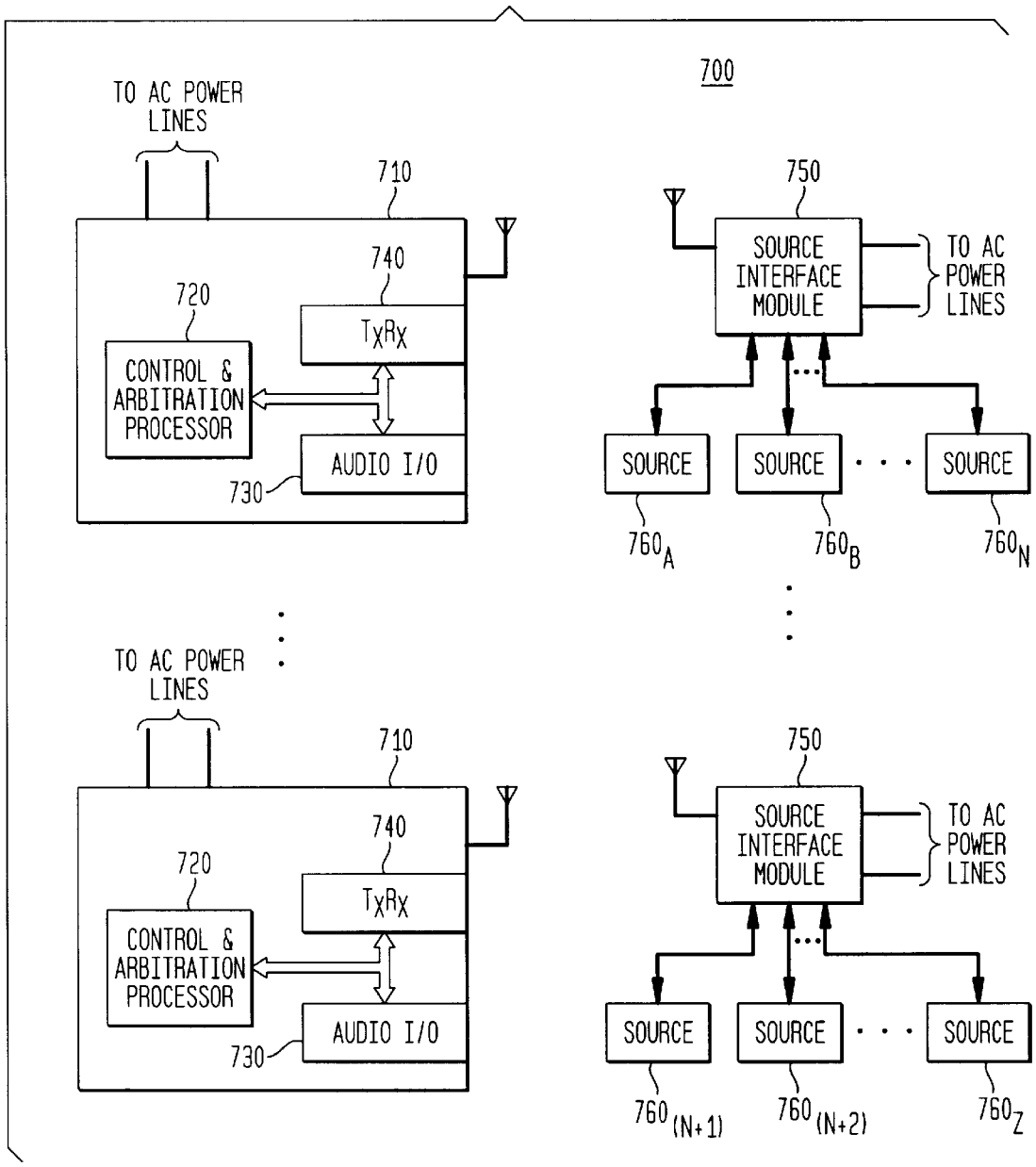
FIG. 7 is a block diagram illustrating a second system embodiment in accordance with the present invention.

FIG. 7 is a block diagram illustrating a second system embodiment 700 in accordance with the present invention. The system 700 includes a plurality of substantially identical intercom units 710. Each of the intercom units 710 includes a control/arbitration processor 720 (which may be part of a processor 130), audio input/output mechanism 730 (such as a speaker and a microphone), and a wireless transceiver 740. Each of the members of the plurality of intercom units 710 can also include other structure and features previously discussed with respect to intercom unit 120.

In the preferred embodiment, the members of the plurality of intercom units 710 are in wireless communication with a plurality of source interface modules 750. Each of the members of the plurality of source interface modules 750, in turn, is coupled to one or more sources 760. The sources 760 could correspond to sources 180. Each of the intercoms 710 may independently execute the processing discussed above with respect to FIGS. 2–6. In the system 700, a user may broadcast between and among any of the various intercoms 710, such as broadcasting a nonstored, verbal message responding to an announced alarm.

Numerous advantages of the embodiments of the present invention may be apparent from the above discussion. First, an annunciation and intercom system is provided which facilitates coupling of disparate types of originating sources, both locally and remotely. Different types of signal sources may be readily mixed and coupled in common to a central annunciation and intercom system that otherwise might not be used with these respective sources. In addition, the preferred system is user friendly, readily installable, enables users to communicate audibly with one another, and usable with both a variety of signal sources and annunciators.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

I claim:

1. An expandable and modular intercom and annunciation system, the system comprising:

a plurality of signal sources;

a plurality of originating interface modules, each originating interface module of the plurality of originating interface modules respectively coupled to a signal source of the plurality of signal sources, the plurality of originating interface modules for receiving respective signals from the corresponding plurality of signal sources and for converting the signals to common communication protocol signals;

a receiving interface module coupled to the plurality of originating interface modules for communication via the common communication protocol; and an intercom and annunciation unit coupled to the receiving interface module to receive the common communication protocol signals, the intercom unit having a processor, having a memory, and having a user interface including an audio output; the processor having instructions to determine relative priorities among the plurality of common communication protocol signals, to select a first common communication protocol signal having a highest relative priority during a selected time interval, from the plurality of common communication protocol signals; the processor having further instructions to announce a message corresponding to the first common communication protocol signal during the selected time interval, and to maintain a quiet interval for an announcement entered via the user interface.

2. The system of claim 1 wherein the receiving interface module is wirelessly coupled to the plurality of originating interface modules.

3. The system of claim 1 wherein the receiving interface module is coupled to the plurality of originating interface modules via AC power lines.

4. The system of claim 1 wherein one of the plurality of signal sources is a smoke detector.

5. The system of claim 1 wherein one of the plurality of signal sources is a fire alarm.

6. The system of claim 1 wherein one of the plurality of signal sources is a carbon monoxide detector.

7. The system of claim 1 wherein one of the plurality of signal sources is an intrusion detector.

8. The system of claim 1 wherein one of the plurality of signal sources is a doorbell.

9. The system of claim 1 wherein one of the plurality of signal sources is a telephone ringing device.

10. The system of claim 1 wherein one of the plurality of signal sources is a paging device.

11. The system of claim 1, further comprising a plurality of intercom and annunciation units, wherein each intercom and annunciation unit of the plurality is coupled to each other intercom and annunciation unit of the plurality of intercom and annunciation units for transmission and announcement of the message corresponding to the first common communication protocol signal during the selected time interval.

12. The system of claim 11, wherein the plurality of intercom and annunciation units determine the relative priorities among the plurality of common communication protocol signals and select the first common communication protocol signal having the highest relative priority during the selected time interval, and wherein the plurality of intercom and annunciation units announce the message corresponding to the first common communication protocol signal during the selected time interval and maintain the quiet interval for an announcement entered via any user interface of the plurality of intercom and annunciation units.

13. The system of claim 1 wherein the memory stores a plurality of pre-recorded messages.

14. An interface apparatus for an intercom and annunciation system, the interface apparatus comprising:

communications circuitry for receiving a plurality of signals indicative of events and for receiving audible, human perceptible messages from displaced sources on a communications channel;

circuitry for storing pre-recorded messages; and a control element coupled to the communications circuitry, to the storage circuitry, and couplable to the intercom and annunciation system, wherein the control element includes circuitry for forming a queue of received event indicating signals, circuitry for announcing events in the list by transferring a respective stored message to the intercom and annunciation system, and circuitry for receiving audible messages from at least one intercom and annunciation unit to be communicated to at least one other, displaced intercom and annunciation unit via the communications channel.

15. The interface apparatus of claim 14 wherein the communications circuitry includes a transmitter of signals via the communications channel to other intercom and annunciation units, and wherein the control element includes a module for resolving channel contention between the transmitter and the displaced sources.

16. The interface apparatus of claim 15 wherein at least the control element is removably coupled to the intercom and annunciation unit.

17. The interface apparatus of claim 15 wherein the module includes tone generation circuitry for producing a channel seizing tone to be transmitted on the channel to the displaced sources.

18. The interface apparatus of claim 15 wherein the control element includes a programmable processor.

19. The interface apparatus of claim 15 wherein the displaced sources are selected from a class of sources which includes at least an intercom, a fire sensor, a gas sensor, an intrusion sensor, a door announcement signal source and a telecommunication alerting device.

20. A system for interconnecting two different signal originating sources, each of which has different electrical output signals, to an intercom module wherein the intercom module has electrical input signal characteristics dissimilar to the electrical output signals of the originating sources, and wherein the intercom module includes audio input and audio output, the system comprising:

first and second conversion circuits, couplable to respective ones of the originating sources, for converting respective electrical output signals of the originating sources to predetermined, communicable electrical signals compatible with the electrical input signal characteristics of the intercom module, and wherein at least some of the predetermined, communicable electrical signals are adapted to activate the audio output; and circuitry for establishing priority between and among output signals from the first and second conversion circuits and a voice input to the intercom module.

21. The system of claim 20 further comprising a plurality of substantially identical intercom modules and wherein the communicable electrical signals are adapted to activate the audio input and output of at least one of the plurality of substantially identical intercom modules.

22. The system of claim 21 which includes a communication link coupled between the conversion circuits and the plurality of intercom modules.

23. The system of claim 22 wherein the communication link supplies electrical energy to at least the conversion circuits.

24. The system of claim 20 wherein each of the plurality of intercom module includes communications circuitry for receiving the communicable electrical output signals.

25. The system of claim 24 wherein the conversion circuits each include programmable source communications circuitry adapted to communicate representations of the electrical output signals from the originating sources to the communications circuitry of the plurality of intercom modules.

26. The system of claim 20 wherein the plurality of intercom modules include programmable silencing circuitry for producing a silent interval, subsequent to receipt of a respective electrical output signal, whereupon a user can inject via the audio input a non-recorded audible message for broadcast by the audio output.

27. The system of claim 26 wherein the circuitry for establishing priority includes channel seizing circuitry to enable the audio output of the intercom module to broadcast a predetermined message.

28. The system of claim 27, further comprising a plurality of source specific interfaces, each source specific interface having a respective conversion circuit of a plurality of conversion circuits.

29. The system of claim 28 wherein the plurality of source specific interfaces are removably couplable to the intercom module.

30. The system of claim 29 wherein the originating sources are selected from a class of originating sources including a door annunciator, a telephone ringer, a smoke detector, a carbon monoxide detector, a movement sensor, and a glass breakage detector.

31. A method of event annunciation, the method comprising:

receiving a plurality of event indicating signals from a respective plurality of event indicating sources;

converting the plurality of event indicating signals to a plurality of originating signals having a common communication format;

prioritizing the plurality of originating signals;

selecting a first originating signal having the highest priority of the plurality of originating signals;

announcing an event on a communication channel in response to the first originating signal having the highest priority;

providing, for selected events, a time interval for entry of a real-time, non-recorded message at a first location, and broadcasting the message on the communication channel to at least a displaced second location.

32. The method of claim 31, further comprising continuing to announce the event subsequent to the broadcasting step.

33. The method of claim 31, further comprising wherein generating a communication channel seizing signal before the announcing step.

34. The method of claim 31, wherein the announcing step includes audibly presenting, at the first location, a prerecorded message.

35. The method of claim 31 wherein the announcing step includes generating, at the first location, a predetermined tone.

* * * * *